US009146066B1

(12) United States Patent
Cason

(10) Patent No.: US 9,146,066 B1
(45) Date of Patent: Sep. 29, 2015

(54) BI-DIRECTIONAL TRIGGER

(71) Applicant: Russell Cason, Myakka, FL (US)

(72) Inventor: Russell Cason, Myakka, FL (US)

( * ) Notice: Subject to any disclaimer, the term of this patent is extended or adjusted under 35 U.S.C. 154(b) by 0 days.

(21) Appl. No.: 14/480,841

(22) Filed: Sep. 9, 2014

(51) Int. Cl.
*F41A 3/00* (2006.01)
*F41A 19/09* (2006.01)
*F41A 19/10* (2006.01)

(52) U.S. Cl.
CPC ..... *F41A 19/09* (2013.01); *F41A 19/10* (2013.01)

(58) Field of Classification Search
CPC ..... F41A 19/00; F41A 19/06; F41A 19/09; F41A 19/10; F41A 19/24; F41A 19/42; F41A 19/43
See application file for complete search history.

(56) References Cited

U.S. PATENT DOCUMENTS

| | | | | | |
|---|---|---|---|---|---|
| 2,136,511 | A * | 11/1938 | Jones | 42/69.01 |
| 4,008,537 | A * | 2/1977 | Elbe | 42/16 |
| 6,125,735 | A * | 10/2000 | Guhring | 89/141 |
| 6,966,138 | B1 * | 11/2005 | Deckard | 42/69.01 |
| 8,667,881 | B1 * | 3/2014 | Hawbaker | 89/139 |
| 8,820,211 | B1 * | 9/2014 | Hawbaker | 89/139 |

FOREIGN PATENT DOCUMENTS

WO WO 2008087234 A1 * 7/2008 ..... F41A 19/02

* cited by examiner

*Primary Examiner* — Gabriel Klein
(74) *Attorney, Agent, or Firm* — Edward P. Dutkiewicz, P.A.

(57) ABSTRACT

A Bi-Directional Trigger assembly comprises a trigger disconnector, and a fire selector. The trigger disconnector ratio of the length of the hammer hook attachment to the length of the hammer hook being about 5.46.

The fire selector has an operational portion having an external diameter. The operational portion has a fire control recess with a depth. The ratio of the operational portion external diameter of the fire selector to the depth of the fire control recess of the operational portion of the fire selector being about 2.2.

10 Claims, 8 Drawing Sheets

BI-DIRECTIONAL TRIGGER

RULE 1.78(F)(1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to a Bi-Directional Trigger for a Firearm and more particularly pertains to having a trigger fire a weapon when moved either rearward or forward.

2. Description of the Prior Art

The use of trigger devices is known in the prior art. More specifically, trigger devices previously devised and utilized for the purpose of causing a firearm to discharge are known to consist basically of familiar, expected, and obvious structural configurations, notwithstanding the designs encompassed by the prior art which has been developed for the fulfillment of stated objectives and requirements.

While the prior art devices fulfill their respective, particular objectives and requirements, the prior art does not describe Bi-Directional Trigger for a Firearm that allows a user to discharge a weapon by moving the trigger of the weapon in either a forward or rearward direction.

In this respect, the Bi-Directional Trigger for a Firearm according to the present invention substantially departs from the conventional concepts and designs of the prior art, and in doing so provides an apparatus primarily developed for the purpose of having a trigger fire a weapon when moved either forward or rearward, thereby increasing the potential rate of fire.

Therefore, it can be appreciated that there exists a continuing need for a new and improved Trigger for a Firearm which can be used to discharge a weapon when moved in either a forward or a rearward direction. In this regard, the present invention substantially fulfills this need.

SUMMARY OF THE INVENTION

In view of the foregoing disadvantages inherent in the known types of trigger devices now present in the prior art, the present invention provides an improved Bi-Directional Trigger for a Firearm. As such, the general purpose of the present invention, which will be described subsequently in greater detail, is to provide a new and improved Bi-Directional Trigger for a Firearm and method which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially, or operationally, continuous with one another.

By adjacent to a structure is meant that the location is near the identified structure.

The term "about" is used to describe the dimensions which are pertinent to this application. The word "about" means an approximation which allows the device to function in a proper manner. Accuracy in measurement is determined by the significant figures used, and the significant figures herein presented teach the generally accepted dimensions for the parts. The dimensions of the preferred embodiment are presented with significant figures which are acceptable within the industry and manufacturing tolerances.

To attain the present invention, which essentially comprises a bi-directional trigger assembly, the description teaches a device which comprises several components, in combination.

There is a trigger disconnector. The trigger disconnector has a generally vertically flat configuration, with two parallel sides and an edge. The disconnector has a thickness between the two parallel sides, with the thickness forming a peripheral edge of the disconnector. The disconnector has an upper portion and a lower portion. The upper portion of the trigger disconnector has an upwardly directed hammer hook attachment, with the hammer hook attachment being continuous with the lower portion of the trigger disconnector. The hammer hook attachment has a length. The length of the hammer hook attachment is about 0.3 inches. In the preferred embodiment, the length of the hammer hook attachment is 0.300 inch.

The disconnector upper portion hammer hook attachment has a forwardly directed hammer hook, with the hammer hook having a length. The length of the hammer hook about 0.05 inch. In the preferred embodiment the length of the hammer hook is 0.055 inch. The hammer hook has an inner, lower, surface and an outer, upper, surface.

The ratio of the length of the hammer hook attachment to the length of the hammer hook being about 5.4. In the preferred embodiment, the ratio of the length of the hammer hook attachment to the length of the hammer hook is 5.455.

The lower portion of the trigger disconnector has a trigger pin hole there through. The lower portion of the trigger disconnector has a lower surface, with the lower surface of the trigger disconnector having a forward portion and a rearward portion. The rearward portion of the trigger disconnector having a downwardly directed spring recess therein.

There is a fire selector. The fire selector has an operational portion and a finger portion. The finger portion of the fire selector has an extension lever. The extension lever of the finger portion of the fire selector has an extension lever and an indicator. The indicator of the finger portion of the fire selector is oriented oppositely from that of the orientation of the extension lever.

The fire selector has a safe orientation and the fire selector has a fire orientation. The safe orientation of the fire selector orients the extension lever of the finger portion in a generally horizontal orientation. The fire orientation of the fire selector orients the extension lever of the finger portion in a generally vertical orientation.

The operational portion of the fire selector has a generally rounded configuration, with an extension lever attachment end and a flat end, with a central area there between. The operational portion of the fire selector has a length of about 0.93 inch from the flat end of the operational portion of the fire selector to the finger portion of the fire selector. In the preferred embodiment, the operation portion of the fire selector has a length of 0.925 inch.

The operational portion of the fire selector has an outermost dimension of the rounded surface, being an external diameter. The external diameter of the operational portion of the fire selector is about 0.37 inch. In the preferred embodiment the external diameter of the rounded surface of the operation portion of the fire selector is 0.370 inch.

The rounded configuration of the operational portion of the fire selector has fire control recess therein. The fire control recess is located in the central area of the operational portion of the fire selector. The fire control recess of the operational portion of the fire selector has a right side and a left side. The right side of the fire control recess is located about 0.30 inch from the flat end of the operational portion of the fire selector. In the preferred embodiment the right side of the fire control recess is located 0.300 inch from the flat end of the operational portion of the fire selector. The left side of the fire control recess is located about 0.63 inch from the flat end of the operational portion of the fire selector. In the preferred embodiment, the left side of the fire control recess is located 0.625 inch from the flat end of the operational portion of the fire selector.

The fire control recess of the fire selector has a depth. The depth of the fire control recess is about 0.17 inch. In the preferred embodiment, the depth of the fire control recess is 0.170 inch. The ratio of the operational portion outermost dimension of the fire selector to the depth of the fire control recess of the operational portion of the fire selector being about 2.2. In the preferred embodiment the ration is 2.176.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

It should also be understood that the dimensions provided are subject to manufacturing tolerances which are acceptable in the industry, and generally acceptable in the machining process when manufacturing the described parts.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Bi-Directional Trigger for a Firearm which has all of the advantages of the prior art trigger devices, and none of the disadvantages.

It is another object of the present invention to provide a new and improved Bi-Directional Trigger for a Firearm which may be easily and efficiently manufactured and marketed.

It is further object of the present invention to provide a new and improved Bi-Directional Trigger for a Firearm which is of durable and reliable constructions.

An even further object of the present invention is to provide a new and improved Bi-Directional Trigger for a Firearm which is susceptible of a low cost of manufacture with regard to both materials and labor, and which accordingly is then susceptible of low prices of sale to the consuming public, thereby making such Bi-Directional Trigger for a Firearm economically available to the buying public.

Even still another object of the present invention is to provide a Bi-Directional Trigger for a Firearm for having a trigger fire a weapon when the trigger is moved either in a forward direction or rearward direction.

Lastly, it is an object of the present invention to provide a new and improved Bi-Directional Trigger assembly comprising a trigger disconnector, and a fire selector. The trigger disconnector ratio of the length of the hammer hook attachment to the length of the hammer hook being about 5.46.

The fire selector has an operational portion having an external diameter. The operational portion has a fire control recess with a depth. The ratio of the operational portion external diameter of the fire selector to the depth of the fire control recess of the operational portion of the fire selector being about 2.2.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
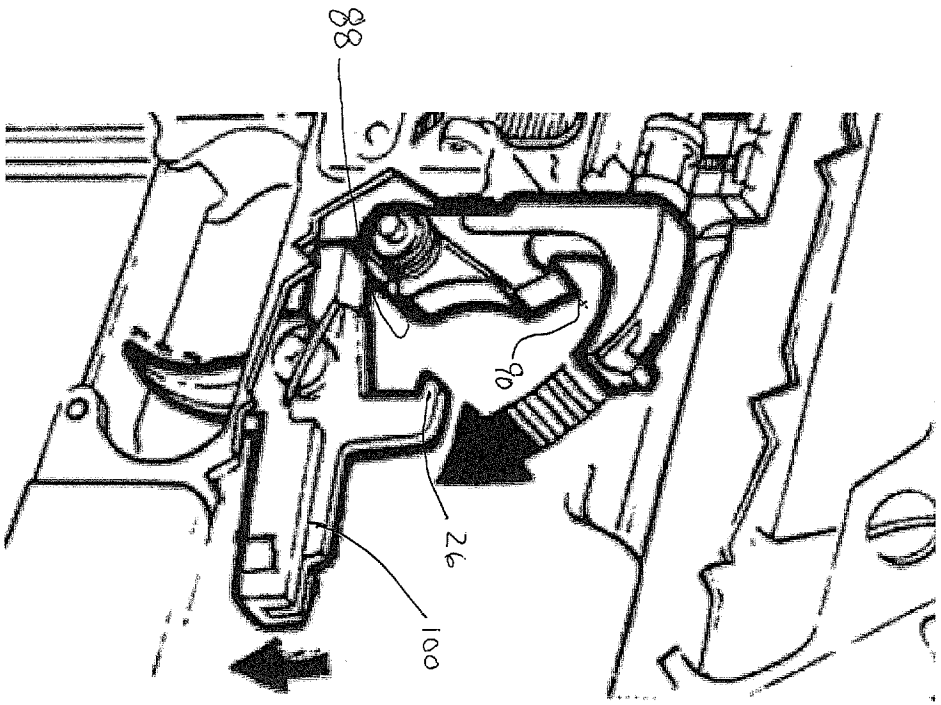
FIG. 1 is a perspective view of the hammer, trigger, and disconnector. The bold arrows indicate the motion when operational. The broken lines related to the trigger show the trigger in the unfired position.

With reference now to the drawings, and in particular to FIG. 1 thereof, the preferred embodiment of the new and improved Bi-Directional Trigger for a Firearm embodying the principles and concepts of the present invention and generally designated by the reference numeral 10 will be described.

The present invention, the Bi-Directional Trigger for a Firearm is comprised of a plurality of components. Such components in their broadest context include a trigger, a trigger disconnector, a hammer and a fire selector. Such components are individually configured and correlated with respect to each other so as to attain the desired objective.

A bi-directional trigger assembly comprising several components, in combination is herein described.

There is a trigger disconnector 12. The trigger disconnector has a generally vertically flat configuration, with two parallel sides 14, 15 and an edge 16. The disconnector has a thickness between the two parallel sides, with the thickness forming the peripheral edge of the disconnector. The disconnector has an upper portion 18 and a lower portion 20. The upper portion of the trigger disconnector has an upwardly directed hammer hook attachment 22, with the hammer hook attachment being continuous with the lower portion of the trigger disconnector. The hammer hook attachment has a length 24. The length of the hammer hook attachment is about 0.3 inches. In the preferred embodiment, the length of the hammer hook attachment is 0.300 inch.

The disconnector upper portion hammer hook attachment has a forwardly directed hammer hook 26, with the hammer hook having a length 28. The length of the hammer hook about 0.05 inch. In the preferred embodiment the length of the hammer hook is 0.055 inch. The hammer hook has an inner, lower, surface 30 and an outer, upper, surface 32.

The ratio of the length of the hammer hook attachment to the length of the hammer hook being about 5.4. In the preferred embodiment, the ratio of the length of the hammer hook attachment to the length of the hammer hook is 5.455.

The lower portion of the trigger disconnector has a trigger pin hole 34 there through. The lower portion of the trigger disconnector has a lower surface 36, with the lower surface of the trigger disconnector having a forward portion 38 and a rearward portion 40. The rearward portion of the trigger disconnector having a downwardly directed spring recess 42 therein.

There is a fire selector 44. The fire selector has an operational portion 46 and a finger portion 48. The finger portion of the fire selector has an extension lever 50. The extension lever of the finger portion of the fire selector has an indicator 52. The indicator of the finger portion of the fire selector is oriented oppositely from that of the orientation of the extension lever.

The fire selector having a safe orientation and the fire selector has a fire orientation. The safe orientation of the fire selector orients the extension lever of the finger portion in a generally horizontal orientation. The fire orientation of the fire selector orients the extension lever of the finger portion in a generally vertical orientation.

The operational portion of the fire selector has a generally rounded configuration 54, with an extension lever attachment end 56 and a flat end 58, with a central area 60 there between. The operational portion of the fire selector has a length of about 0.93 inch from the flat end of the operational portion of the fire selector to the finger portion of the fire selector. In the preferred embodiment, the operation portion of the fire selector has a length of 0.925 inch.

The operational portion of the fire selector has an outermost dimension 62 of the rounded surface, being an external diameter. The external diameter of the operational portion of the fire selector is about 0.37 inch. In the preferred embodiment the external diameter of the rounded surface of the operation portion of the fire selector is 0.370 inch.

The rounded configuration of the operational portion of the fire selector has fire control recess 64 therein. The fire control recess is located in the central area of the operational portion of the fire selector. The fire control recess of the operational portion of the fire selector has a right side 66 and a left side 68. The right side of the fire control recess is located about 0.30 inch from the flat end of the operational portion of the fire selector. In the preferred embodiment the right side of the fire control recess is located 0.300 inch from the flat end of the operational portion of the fire selector. The left side of the fire control recess is located about 0.63 inch from the flat end of the operational portion of the fire selector. In the preferred embodiment, the left side of the fire control recess is located 0.625 inch from the flat end of the operational portion of the fire selector.

The fire control recess of the fire selector has a depth 70. The depth of the fire control recess is about 0.17 inch. In the preferred embodiment, the depth of the fire control recess is 0.170 inch. The ratio of the operational portion outermost dimension of the fire selector to the depth of the fire control recess of the operational portion of the fire selector being about 2.2. In the preferred embodiment the ration is 2.176.

The present invention radically changes the trigger function in the AR-15 rifle, doubling the rate of fire achievable by that weapon system. The present invention causes the trigger to fire the weapon when the trigger is pulled rearward and when the trigger is moved forward, which is herein referred to as "trigger return".

In the standard, prior art, AR-15, the forward length of the hammer hook of the hammer hook attachment of the disconnector is about 0.105 inch. The upward projection, or height, of the upper portion in the prior art AR-15 trigger disconnector, the hammer hook attachment, is about 0.300 inch. The ratio of the height of the hammer hook attachment of the disconnector to the forward length of the hammer hook of the disconnector is 0.300 inch to 0.105 inch, or about 2.857.

The forward length of the upwardly directed, upper portion of the disconnector, the hammer hook attachment, of the present invention is between about 0.050 inch to 0.075 inch. In the preferred embodiment, the hammer hook forward length is 0.055 inch.

The upward projection, or height of the hammer hook attachment of the disconnector, is measured from the hammer hook inner surface, downward. The dimension is the same as the standard AR-15 rifle trigger disconnector, which is about 0.300 inch, being within standard manufacturing tolerances. In the herein modified configuration, the ratio of the upper portion height of the hammer hook attachment to the forward length of the hammer hook is about 5.46. In the preferred embodiment, the ratio of the upper portion height of the hammer hook attachment to the forward length of the hammer hook is 5.455. In essence, the hammer hook is shorter in the present invention.

All semi-automatic firearms can fire at a rate determined by the speed of trigger pull by the shooter. The present invention allows a user to double the rate of fire by allowing the firearm to discharge when the trigger is moved rearward and when the trigger is moved forward. The National Firearms Act defines a machine gun as a firearm which discharges more than one round with a single pull of the trigger. This device changes the firing configuration so that a firearm discharges in both directions of trigger travel, or trigger function.

The device is best understood when the original configuration is compared to the present device throughout the normal cycling of the firearm mechanism.

There are four components of the trigger system in a standard AR-15 semi-automatic rifle which are found within a lower receiver of the AR-15. The AR-15 is the civilian, semi-automatic version of the military, fully automatic M-16, first developed in the late 1950's and initially deployed during the Vietnam conflict.

Figure 2:
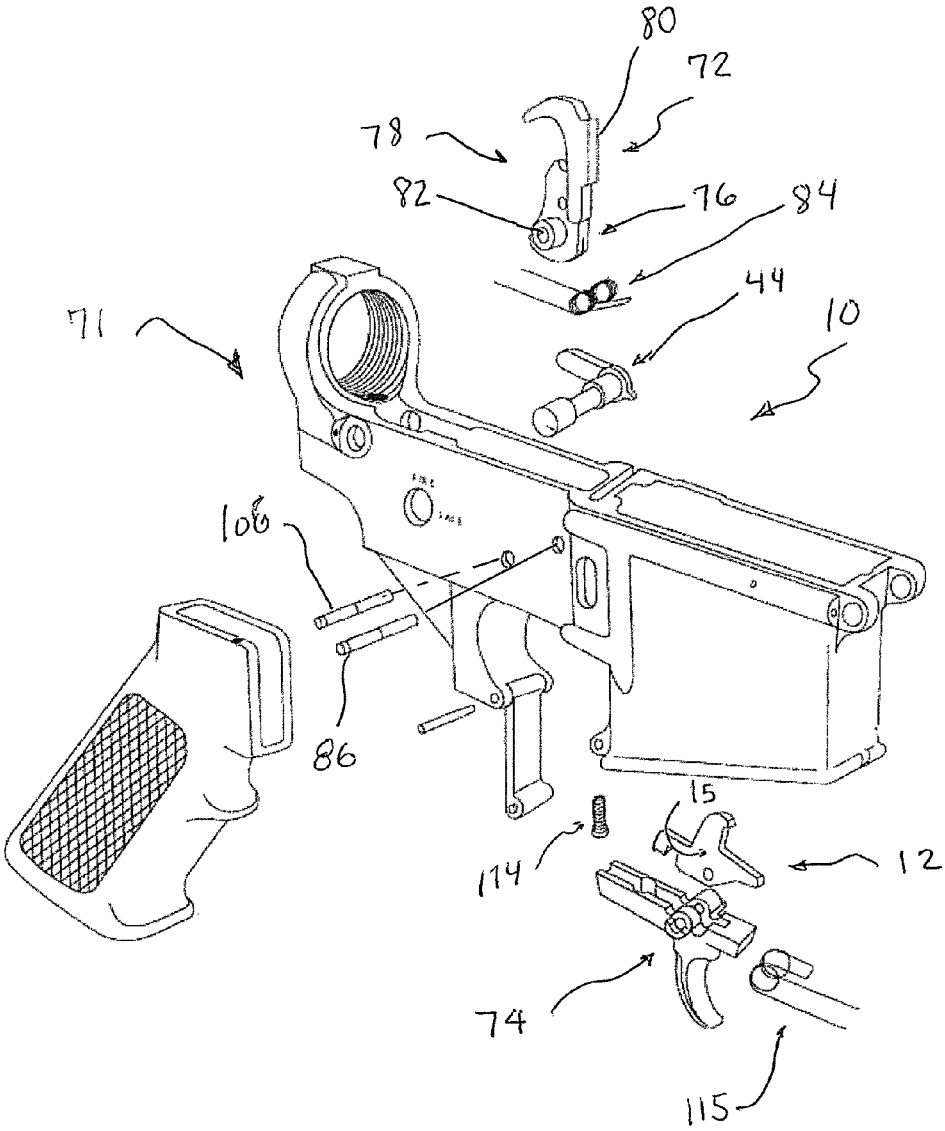
FIG. 2 is an exploded view of the parts of the lower receiver of the ar 15, showing the hammer, fire selector, also known as a safety, the trigger and disconnector. Pins and springs are also shown.
Figure 3:
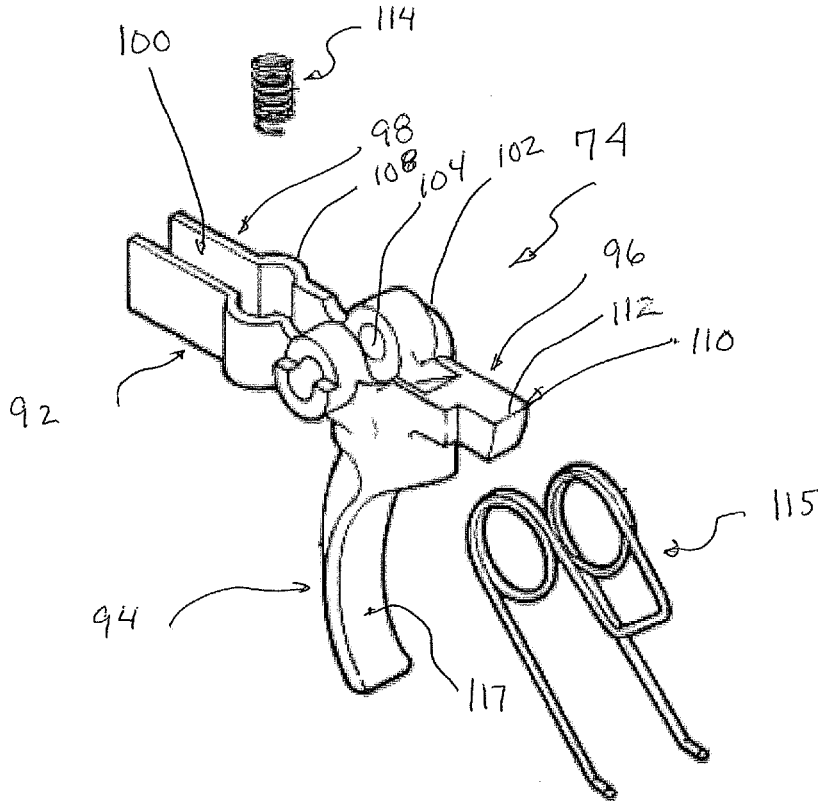
FIG. 3 is a close up view of the trigger, showing the trigger spring and the disconnector spring.

Referring to FIG. 2, showing the exploded lower receiver 71 parts which are pertinent to this invention, the four parts to be discussed are the hammer 72, the trigger 74, the disconnector 12 and the fire selector 44.

The hammer has a lower portion 76 and an upper portion 78. The upper portion has a striking surface 80 and the lower portion has a pivoting point 82. The hammer has an associated spring 84 for biasing the hammer in the forward, and upright position. The hammer and hammer spring is held in place by a hammer pin 86. The hammer can be held back, against the hammer spring tension, in the "cocked" position, wherein the hammer is rearward and relatively horizontal to the "uncocked" or "firing" position. The lower portion of the hammer has a trigger catch 88. The catch is in the configuration of a slot on an oblong surface, so that one side of the catch has a greater projection than the other side of the catch.

The hammer has a rearward surface which has a disconnector catch 90.

The trigger has an upper portion 92 with a length and a lower portion 94. The length of the upper portion of the trigger has a forward end 96 and a rearward end 98. The upper portion is generally rectilinear with a continuous groove 100 along the length from the forward end of the upper portion of the trigger to the rearward end of the upper portion of the trigger. The upper portion of the trigger has a pair of upwardly directed trigger tabs 102 with each trigger tab having a trigger pin hole 104 there through. A trigger pin 106 rotatably fixes the trigger and disconnector in position within the lower receiver of the AR 15.

The upper portion of the trigger has an upper surface 108, which is generally flat, except for the upwardly directed trigger tabs. The forward end of the upper portion of the trigger has a forward extent 110 which has a generally angular corner 112. By "generally angular" means that the corner has at least two intersecting surfaces that meet. The angle formed by the meeting of the surfaces generally forms a point. The trigger has an associated disconnector spring 114, which is nested in the trigger groove. The trigger has a biasing spring 115, which holds the trigger in the forward, unfired position.

The lower portion of the trigger is partially crescent shaped 117, and is well known in the art.

Figure 4:
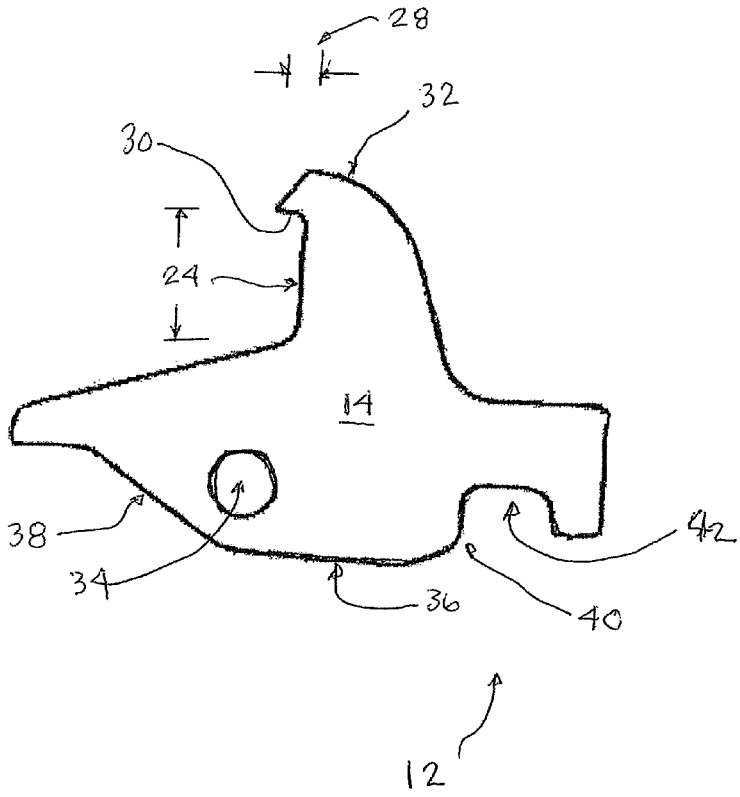
FIG. 4 is a plan side view of the disconnector.
Figure 5:
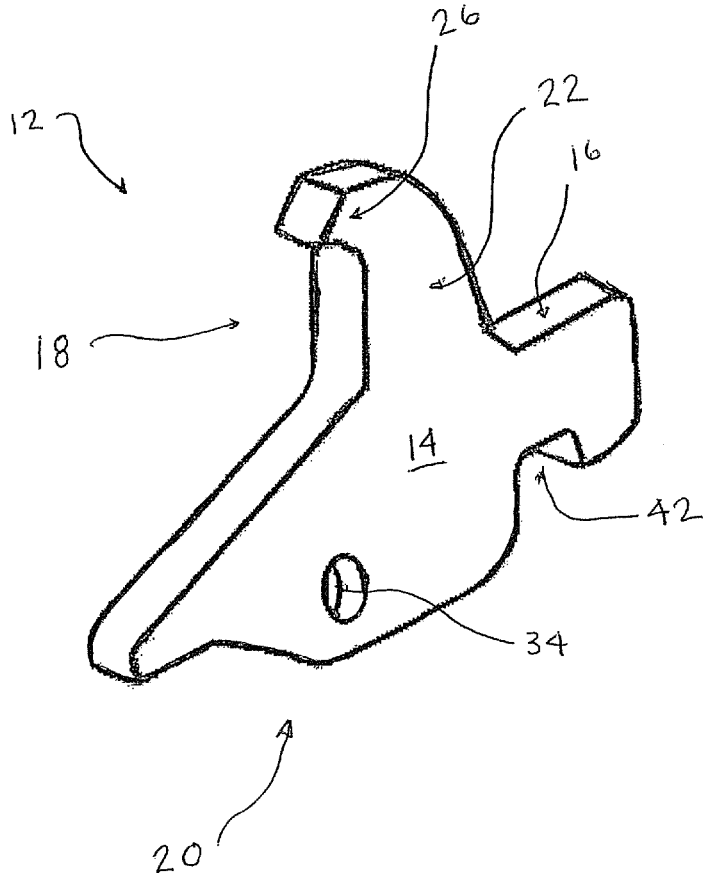
FIG. 5 is a perspective view of the disconnector.
Figure 6:
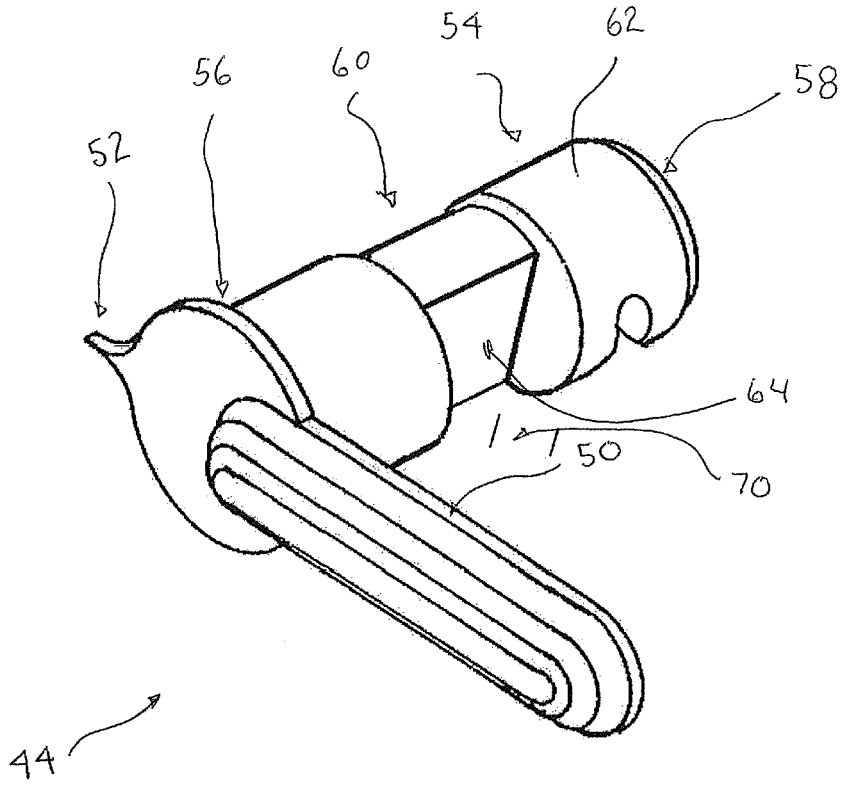
FIG. 6 is perspective view of the fire selector.
Figure 7:
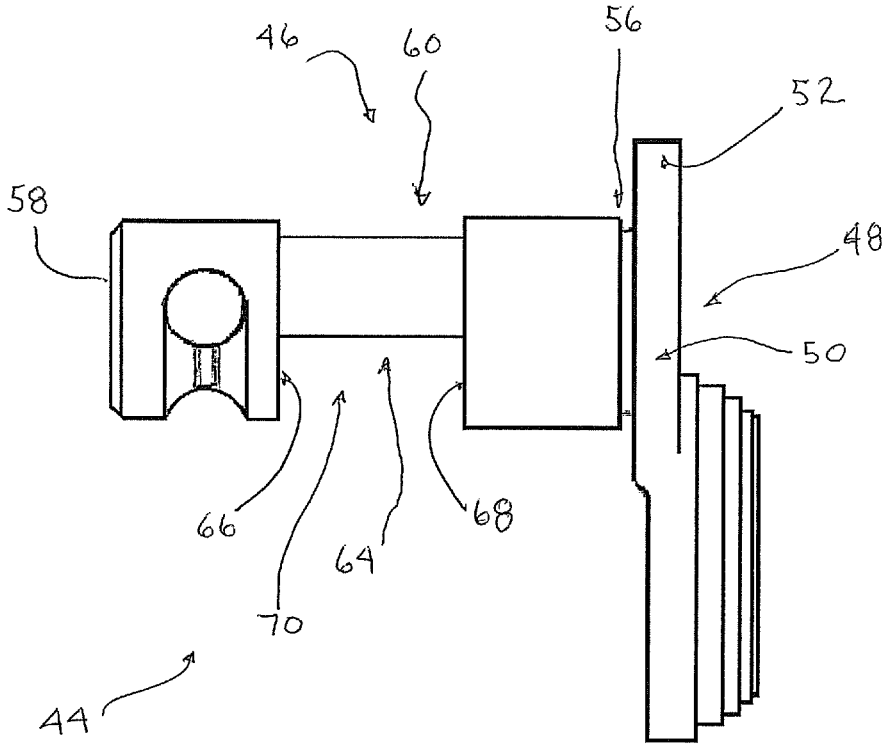
FIG. 7 is a plan front view of the fire selector.
Figure 8:
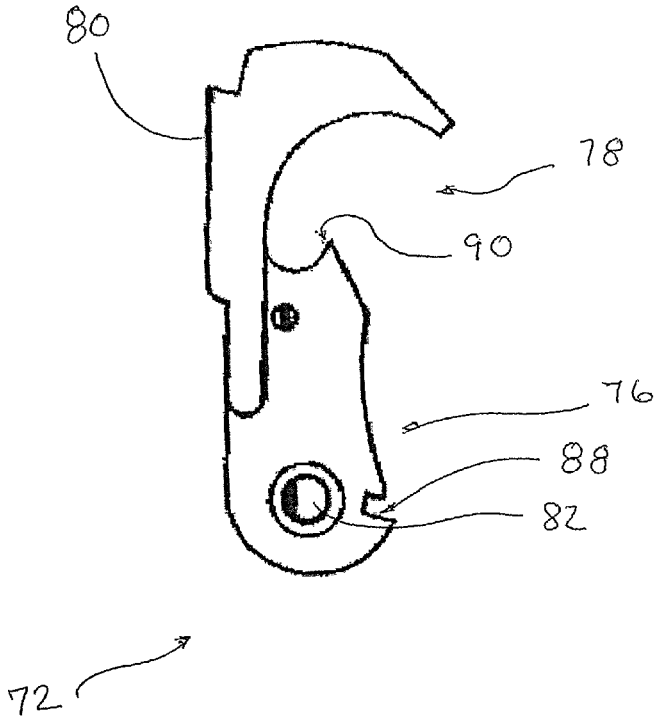
FIG. 8 is a side elevational view of the hammer.

The disconnector, as previously described, has a generally vertically flat configuration, with two parallel sides 14, 15 and an edge 16. The disconnector has a thickness between the two parallel sides, and the thickness forms the edge of the disconnector. The disconnector has an upper portion 18 and a lower portion 20. The trigger disconnector upper portion has an upwardly directed hammer hook attachment 22, with the hammer hook 26 being forwardly oriented, with the hook having a forward length 24, as shown in FIG. 4. The disconnector lower portion has a trigger pin hole 34 there through. The lower portion of the trigger disconnector has a forward portion and a rearward portion, with the rearward portion having a downwardly directed spring receiver 42. The disconnector spring 114 is located within the spring receiver of the disconnector, and is nested within the groove of the trigger upper portion. The disconnector spring biases the disconnector rearward portion in the upward direction, causing the hook of the disconnector to pivot forward and rearward portion of the disconnector to pivot upward, around the trigger pin. In use the disconnector is biased forward.

When the firearm is cycled, so as to load a round into the chamber, the bolt is pulled rearward, an action well known in the art and not discussed herein. The bottom of the bolt strikes the top of the hammer, forcing the hammer rearward, rotating the hammer rearward and down, as the hammer pivots around the hammer pin which mounts the hammer to the receiver, as shown in FIG. 1. As the hammer is pushed back, the forward squared end of the trigger engages the trigger catch of the hammer, holding the hammer in the cocked position. The bolt then returns, under spring bias, to battery, pushing a round from the magazine into the chamber. As the bolt reaches the barrel extension grooves, the lugs of the bolt, not shown, but well known in the art, contact and rotate within the barrel extension, not shown. Thereby locking the bolt in battery. The hammer is held back pending release by the trigger, and the weapon is ready to fire.

The firearm has a fire selector. The fire selector is a pin which connects the right side of the firearm with left side of the firearm. In other words, the fire selector is coupled to the firearm on both sides of the receiver.

The fire selector has an operational portion and a finger portion. The finger portion of the fire selector has an inside surface and an outer surface, the inside surface being generally flat and the outer surface being contoured, allowing for easy movement by a user's finger, from the safe position to the fire position.

The finger portion of the fire selector has an extension lever. The extension lever allows a user to push a finger against the lever and rotate the fire selector from the horizontal position, the safe position, to the vertical position, the fire position, by pushing the finger in a downward direction against the finger portion of the fire selector.

The indicator of the finger portion of the fire selector is oriented oppositely from that of the orientation of the extension lever of the finger portion of the fire selector.

The fire selector has a safe orientation and the fire selector has a fire orientation. The safe orientation of the fire selector orients the extension lever of the finger portion in a generally horizontal orientation. The fire orientation of the fire selector orients the extension lever of the finger portion in a generally vertical orientation.

The operational portion of the fire selector has a generally rounded configuration, in the form of a solid round pin, with an extension lever attachment end and a flat end. In the preferred embodiment, the operational portion of the fire selector has a length of about 0.925 inch, measured from the flat end of the operational portion of the fire selector to the inside surface of the finger portion of the fire selector. This length is the length between the outside surfaces of the left and right sides of the receiver. The operational portion of the fire selector having an outermost dimension of the rounded surface, with the diameter of the operational portion of the fire selector being about 0.37 inch, plus or minus twelve percent. In the preferred embodiment, the diameter of the operation portion of the fire selector is 0.370 inch.

The rounded configuration of the operational portion of the fire selector having fire control recess therein. The fire control recess of the operational portion of the fire selector has a right side and a left side. The right side of the fire control recess is located about 0.30 inch from the flat end of the operational portion of the fire selector. In the preferred embodiment, the right side of the fire control recess is located about 0.300 inch from the flat end of the operational portion of the fire selector. The left side of the fire control recess is located about 0.62 inch from the flat end of the operational portion of the fire selector. In the preferred embodiment the left side of the fire control recess is located about 0.625 inch from the flat end of the operational portion of the fire selector.

The fire control recess of the operational portion of the fire selector has a depth. The depth of the fire control recess being about 0.17 inch, plus or minus twelve percent. In the preferred embodiment, the depth of the fire control recess is 0.170 inch. The ratio of the diameter of the operational portion of the fire selector to the depth of the fire control recess of the operational portion of the fire selector is about 2.2. In the preferred embodiment, the ratio of the diameter of the operational portion of the fire selector to the depth of the fire control recess of the operational portion of the fire selector is 2.176.

The fire selector has a generally stepped and round pin shaped configuration, that is, the pin is round with one or more recesses cut into sections of the pin surface.

The recesses contact and overlap each other, with each recess having a depth, which is measured from the outside diameter of the operation portion of the fire selector to the deepest surface of the recess.

The indicator of the fire selector is oriented in parallel with the lever. When the fire selector lever is in the "safe" position, the rounded surface of the pin contacts rearward end of the trigger, thereby preventing the rear portion of the trigger from moving upward, around the trigger pin. This prevents the trigger from being "pulled", and the weapon discharged. It should be noted that the fire selector can only be engaged when the weapon is "cocked", or ready to fire.

The fire selector is located in the firearm so that the rearward portion of the trigger is adjacent the rounded pin configuration when in the safe position.

If the fire selector is in the "safe" position, the external diameter of the central portion of the fire selector causes the trigger to be pressed downward, preventing the trigger from being pulled, keeping the forward squared portion of the trigger engaged in the trigger catch of the hammer.

When the fire selector is rotated to the "fire" position, that is, the finger presses the extension downward, rotating the fire selector about ninety degrees in a clockwise motion, the fire control recess is located adjacent the rearward end of the trigger, and the recess location allows the trigger to be pulled, moving the rearward portion of the trigger upward.

When the lower portion of the trigger is moved rearward, the trigger pivots around the trigger pin and rotates the disconnector forward. The forward rotation of the trigger causes the squared forward portion of the trigger to disengage from the hammer catch. The hammer then rotates forward when the trigger is pulled, striking the firing pin, and causing the firearm to discharge. The discharge causes the bolt to rotate and unlock, allowing the bolt and bolt carrier to move rearward. The bolt carrier contacts the upper portion of the hammer, forcing the hammer to rotate rearward as the bolt carrier pushes the hammer rearward. When the hammer rotates rearward, with the trigger continued to be in the rearward, pulled, orientation, the hammer lip contacts and becomes engaged with the hook of the disconnector, causing the hammer to be held back in the cocked position. This all occurs while the trigger is still in the rearward, pulled, position. In this position the forward angled extent of the trigger cannot contact the hammer.

The bolt goes through the rearward ejection action and the forward reloading action, and again locks, making the firearm ready to fire. At this time the trigger remains pulled, with the disconnector, at this time, holding the hammer back in the cocked position. The forward portion of the trigger is not engaged in the hammer catch.

When the trigger pull is released, and allowed to mover forward, thereby moving the forward portion of the trigger up and the rearward portion of the trigger down, the disconnector is pulled back, and disengages from the lip of the hammer. The shorter disconnector hook 26 allows the hammer to become free of the disconnector sooner than in the prior art. Also, the larger recess in the fire selector allows the trigger to be pulled more rearward, allowing the forward angled extent of the trigger to be in a greater downward location, compared to the known prior art. These two changes allow the hammer to disengage from the disconnector and not engage the trigger, thereby allowing the firearm to fire when the trigger is moved forward, to the ready to fire, forward, position.

The firearm then fires, with the trigger now in the forward, un-pulled position, at which time the bolt forces the hammer back, with the trigger forward end now engaging the catch of the hammer. The disconnector, in this firing cycle, does not engage the hammer lip, and does not retain the hammer, but the trigger forward end engages the hammer catch, holding the hammer in a cocked position.

At the same time, the rear portion of the trigger had then rotated downward, caused by the trigger biasing spring, causing the squared forward end of the trigger to move upward, placing the squared portion of the trigger in position to engage the catch of the hammer, thereby holding the hammer in the cocked position, until the trigger is pulled once again.

Changes made to the disconnector and the fire selector affect the overall function of the firearm, making bi-directional trigger activation possible, where it is not possible in the configuration of the commonly available AR-15 rifle.

The disconnector, in the herein described modification, has the generally vertically flat configuration, with an upper portion and a lower portion. The trigger disconnector upper portion has an upwardly directed trigger hook, with the hook extent being forwardly oriented, with the hook having a forward length. In the standard AR-15, the forward length of the hook is 0.105 inch. The upward projection, or height, of the upper portion in the standard AR-15 is 0.300 inch. The ratio of the upper portion height to the forward length is 0.300 to 0.105, or 2.857.

The upwardly directed, upper portion of the disconnector, trigger hook forward length of the present invention is 0.055 inch. The upward projection, or height of the upper portion is the same as the standard AR-15 rifle disconnector, which is 0.300 inch. In the herein modified configuration, the ratio of the upper portion height to the forward length is 0.300 inch to 0.055 inch, or 5.455. This change results in a 191% increase in the ration of height to forward length of the upper portion of the disconnector.

This substantial change in ratio of height to forward length translates into the disconnector being allowed to disengage with the hammer lip sooner than in the standard AR-15. This means that as the trigger moves forward, after the full rearward pull, the disconnector allows the hammer to move forward, before the trigger forward portion can engage the trigger catch of the lower portion of the hammer. This allows the rifle to fire when the trigger is moved forward. This function is not possible with the currently manufactured AR-15 rifle, and this herein described invention represents a complete and novel change in the firing mechanisms of any semi-automatic rifle, allowing a doubling of the rate of fire of a semi-automatic rifle, in particular, the AR-15, though this technology is applicable to a wide range of semi-automatic firearms.

In the current invention, to use the fire selector to make the firearm "safe" after the trigger is pulled rearward, and held rearward, one must pull back the bolt, using the charging handle, release the trigger, and thereafter allow the bolt to close. This action allows the bolt to hold back the hammer while the trigger is released, allowing the forward end of the trigger to move upward and engage the trigger catch of the hammer. At this time the fire selector may be moved into the "safe" orientation. The firearm is now in the safe mode, and the trigger is ready to be pulled, when the fire selector is rotated to the fire position.

There have been many attempts to increase the rate of fire of the AR-15, as well as other civilian versions of military weapons, such as the AK-47. Such attempts have included changes to the stock configuration, which allows a rifle receiver, which includes the trigger, to slide back and forth, essentially assisting the user in pulling the trigger. While these inventions "work", these inventions do not give user, that is, the person pulling the trigger, control over the firearm.

The present invention allows variable rapid fire which is governed by the trigger pull and trigger release. The rate of fire can be anywhere in the range from intermittent firing to sustained, full magazine discharge at the rate comparable to fully automatic weapons.

The problem for the civilian market is that the Federal Statutes closely regulate how a weapon can fire. The present invention stays within the federal requirement that the weapon discharges one round with a single function of the trigger. The invention is that the weapon now discharges, in a single function as a pulled trigger, and a single function as a pushed trigger, that is, the trigger returned to the original "unpulled" orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bi-directional trigger assembly comprising, in combination:

a firearm having a receiver;

a trigger disconnector having an upper portion and a lower portion, the upper portion having an upwardly directed hammer hook attachment, the hammer hook attachment having a length, the upper portion hammer hook attachment having a forwardly directed hammer hook with the hammer hook having a length, the ratio of the length of the hammer hook attachment to the length of the hammer hook being about 5.46, plus or minus ten percent;

a fire selector having an operational portion and a finger portion, the operational portion of the fire selector having an outermost dimension of a rounded surface being an external diameter, with the rounded surface of the operational portion of the fire selector having fire control recess therein, the fire control recess of the fire selector having a depth, the ratio of the operational portion external diameter of the fire selector to the depth of the fire control recess of the operational portion of the fire selector being about 2.2, the fire selector having a safe orientation and the fire selector having a fire orientation; and a trigger assembly pin, the trigger assembly pin operatively coupling a trigger and the trigger disconnector to the firearm receiver; wherein the trigger causes discharge of the firearm when the trigger is moved in a pulled, rearward direction and the trigger subsequently causes another discharge of the firearm upon trigger return.

2. The bi-directional trigger assembly as described in claim 1 wherein the lower portion of the disconnector has a lower surface with the lower surface of the disconnector having a forward portion and a rearward portion.

3. The bi-directional trigger assembly as described in claim 2 wherein the length of the hammer hook attachment is about 0.3 inches, and the length of the hammer hook is about 0.05 inch.

4. The bi-directional trigger assembly as described in claim 3 with wherein the hammer hook attachment of the upper portion of disconnector is continuous with the lower portion of the disconnector; and the depth of the fire control recess of the operational portion of the fire selector is about 0.17 inch, plus or minus ten percent.

5. The bi-directional trigger assembly as described in claim 4 with wherein the rearward portion of the lower portion of the disconnector has a downwardly directed spring recess therein;

the external diameter of the operational portion of the fire selector is about 0.37 inch; and the trigger assembly pin is solid.

6. The bi-directional trigger assembly as described in claim 5 wherein the trigger disconnector has a generally vertically flat configuration, with two parallel sides and an edge; and the fire selector operational portion has a left extension lever attachment end and a right flat end and a central area there between, the operational portion of the fire selector having a generally rounded configuration, the fire control recess being located in the central area of the operational portion of the fire selector, the fire control recess having a right side and a left side with the right side of the fire control recess being located about 0.30 inch from the flat end of the operational portion of the fire selector and the left side of the fire control recess being located about 0.63 inch from the flat end of the operational portion of the fire selector.

7. The bi-directional trigger assembly as described in claim 6 wherein the hammer hook has an inner surface and an outer surface, the lower portion of the trigger disconnector has a trigger pin hole there through; and the finger portion of the fire selector has an extension lever and an indicator, the indicator of the finger portion being oriented oppositely from that of the orientation of the extension lever.

8. The bi-directional trigger assembly as described in claim 7 wherein the trigger disconnector has a thickness between the two parallel sides, with the thickness forming a peripheral edge of the trigger disconnector; and the safe orientation of the fire selector orients the extension lever of the finger portion in a generally horizontal orientation, and the fire orientation of the fire selector orients the extension lever of the finger portion in a generally vertical orientation.

9. The bi-directional trigger assembly as described in claim 8 wherein the operational portion of the fire selector has a length of about 0.93 inch from the flat end of the operational portion of the fire selector to the finger portion of the fire selector.

10. A method for making a firearm having a bi-directional trigger pull, comprising:

providing a firearm having a receiver;

providing a trigger disconnector having an upper portion, the upper portion having an upwardly directed hammer hook attachment, the hammer hook attachment having a length, the upper portion hammer hook attachment having a forwardly directed hammer hook with the hammer hook having a length, the ratio of the length of the hammer hook attachment to the length of the hammer hook being about 5.46;

providing a trigger having a rearward, pulled orientation and a forward, unpulled orientation, the trigger disconnector being coupled to the trigger;

providing a hammer having a hammer lip, the hammer lip configured to contact the trigger disconnector when the trigger is in the pulled orientation, the hammer being coupled to the firearm receiver;

providing a fire selector having an operational portion having an external diameter, the fire selector having fire control recess therein, the fire control recess of the fire selector having a depth, the ratio of the operational portion external diameter of the fire selector to the depth of the fire control recess of the operational portion of the fire selector being about 2.2; and providing a trigger assembly pin, the trigger assembly pin operatively coupling the trigger and trigger disconnector to the firearm receiver;

wherein the trigger causes discharge of the firearm when the trigger is moved in a pulled, rearward direction and the trigger subsequently causes another discharge of the firearm upon trigger return.

* * * * *